US005664756A

United States Patent [19]

Liao

[11] Patent Number: 5,664,756

[45] Date of Patent: Sep. 9, 1997

[54] ARTICLE STAND

[76] Inventor: Yuan-Chi Liao, No.2, Lane 304, Ching-Cheng Road, Taichung, Taiwan

[21] Appl. No.: 719,084

[22] Filed: Sep. 26, 1996

[51] Int. Cl.[6] ..... G10D 3/00

[52] U.S. Cl. ..... 248/443; 84/327

[58] Field of Search ..... 248/443, 167, 248/173, 460; 84/327, 453

[56] References Cited

U.S. PATENT DOCUMENTS

| | | | |
|---|---|---|---|
| 5,375,497 | 12/1994 | Pirchio et al. | 248/443 X |
| 5,383,634 | 1/1995 | Liao | 84/327 X |
| 5,505,413 | 4/1996 | Hennessey | 84/327 X |

FOREIGN PATENT DOCUMENTS

| | | | |
|---|---|---|---|
| 2276314 | 9/1994 | United Kingdom | 84/327 |

*Primary Examiner*—Leslie A. Braun
*Assistant Examiner*—Long Dinh Phan
*Attorney, Agent, or Firm*—Morton J. Rosenberg; David I. Klein

[57] ABSTRACT

This invention disclosed an article stand. It includes a tripod having a first leg, a second leg, and a third leg. The article stand further includes two support levers each including an adjustment section and a support section, whereby the space between the support sections and the first and second legs can be changed for receiving different thickness of various kinds of guitars or articles. Also, this support levers can be folded for storage.

7 Claims, 6 Drawing Sheets

ARTICLE STAND

BACKGROUND OF THE INVENTION

The present invention relates to a foldable and space-adjustable article stand for different thickness of various kinds of guitars to rest thereon.

FIG. 1 shows a conventional article stand for a guitar to rest thereon. Such article stand includes two vertical levers 11 pivotally connected with each other at top ends. The longitudinal levers 11 can be laterally pulled away from each other. Two horizontal beams 12 are respectively connected with bottom ends of the longitudinal levers 11 and are parallel to the ground so as to prevent the article stand from tilting down when suffering forward or rearward force. Two arched support arms 13 are respectively pivotally connected with the longitudinal levers 11 on the same side and at the same height for receiving and bearing the body 14 of the guitar. The support arms 13 can be upward pivoted with their free ends contacting with the longitudinal levers 11 in a collected state.

Several shortcomings exist in the above article stand as follows:

1. Only one single dimension is available. The support arms 13 have fixed length so that only those bodies of the guitars with identical thickness can be supported thereby. That is, the body of the wooden guitar with larger thickness cannot be rested on the article stand adapted to the body of the electrical guitar with less thickness. Reversely, the body of the guitar with less thickness can be hardly stably located and rested on the article stand adapted to the body of the guitar with larger thickness. Therefore, the above article stand cannot be adjusted according to the thickness of the body of the guitar and is only adapted to a specific guitar with a body having a suitable thickness.

2. The above article stand has large volume. Only the support arms 13 and the longitudinal levers 11 of the article stand can be folded toward each other. Moreover, the support arms 13 protrude from the vertical levers 11. Also, the horizontal beams 12 are fixed at the bottom ends of the vertical levers 11 and cannot be folded. Therefore, the above article stand occupies a considerably large space.

SUMMARY OF THE INVENTION

It is therefore a primary object of the present invention to provide an article stand including a tripod having three foldable legs. Two support levers are pivotally connected with two of the legs. The support levers can be folded and received in the legs or unfolded to support the body of the guitar. The space between the support levers and the legs can be adjusted in accordance with different thickness of the bodies of various guitars. Two tiltproof rods are pivotally connected with the bottom ends of the two legs for increasing the contacting area and lowering the gravity center so as to prevent the article stand from tilting down when suffering external force. The tiltproof rods can be folded to lean on the two legs, whereby the article stand can be contracted into a substantially straight line skate with a minimized volume.

The present invention can be best understood through the following description and accompanying drawings, wherein:

DETAILED DESCRIPTION OF THE PREFERRED EMBODIMENTS

Figure 1:
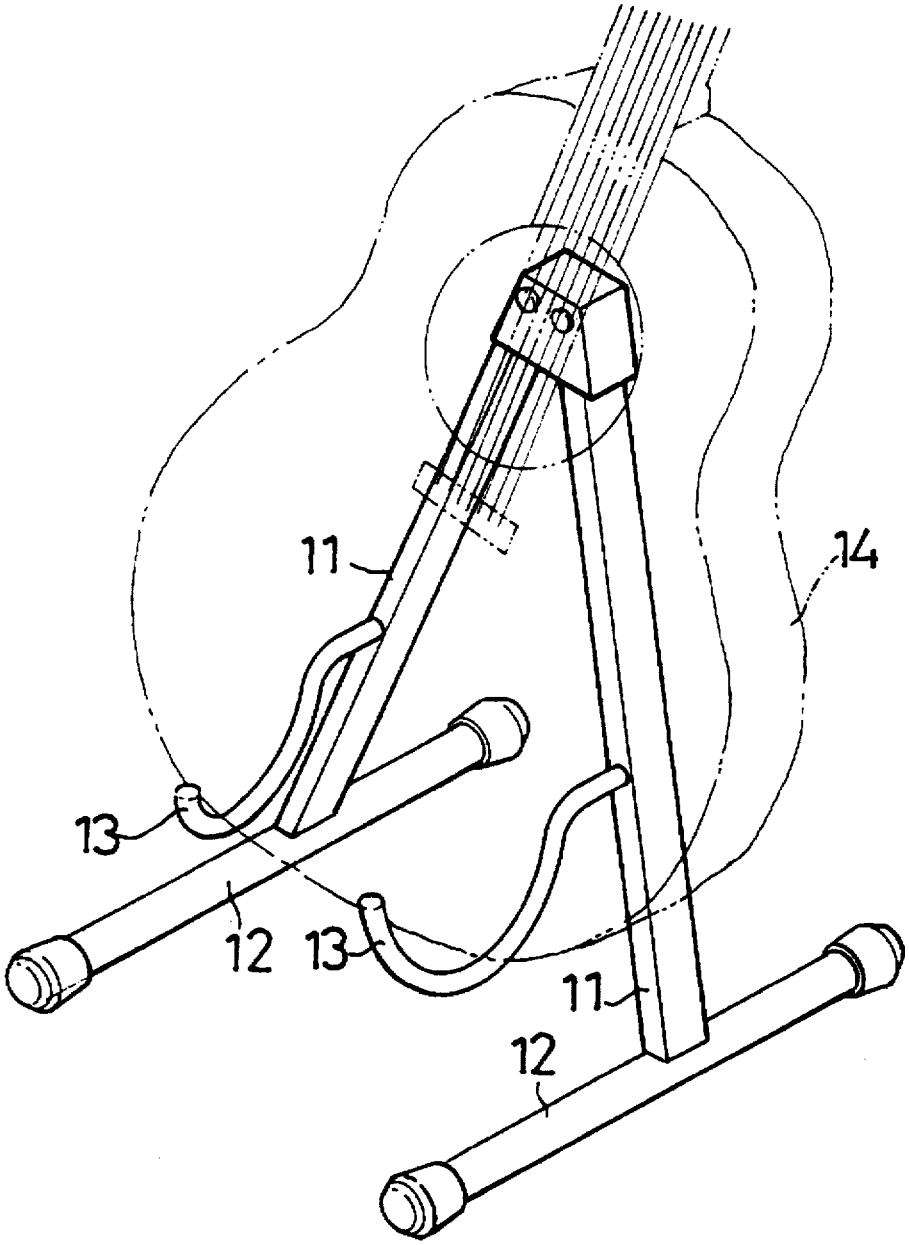
PRIOR ART FIG . 1
FIG. 1 shows a conventional article stand for a guitar.
Figure 2:
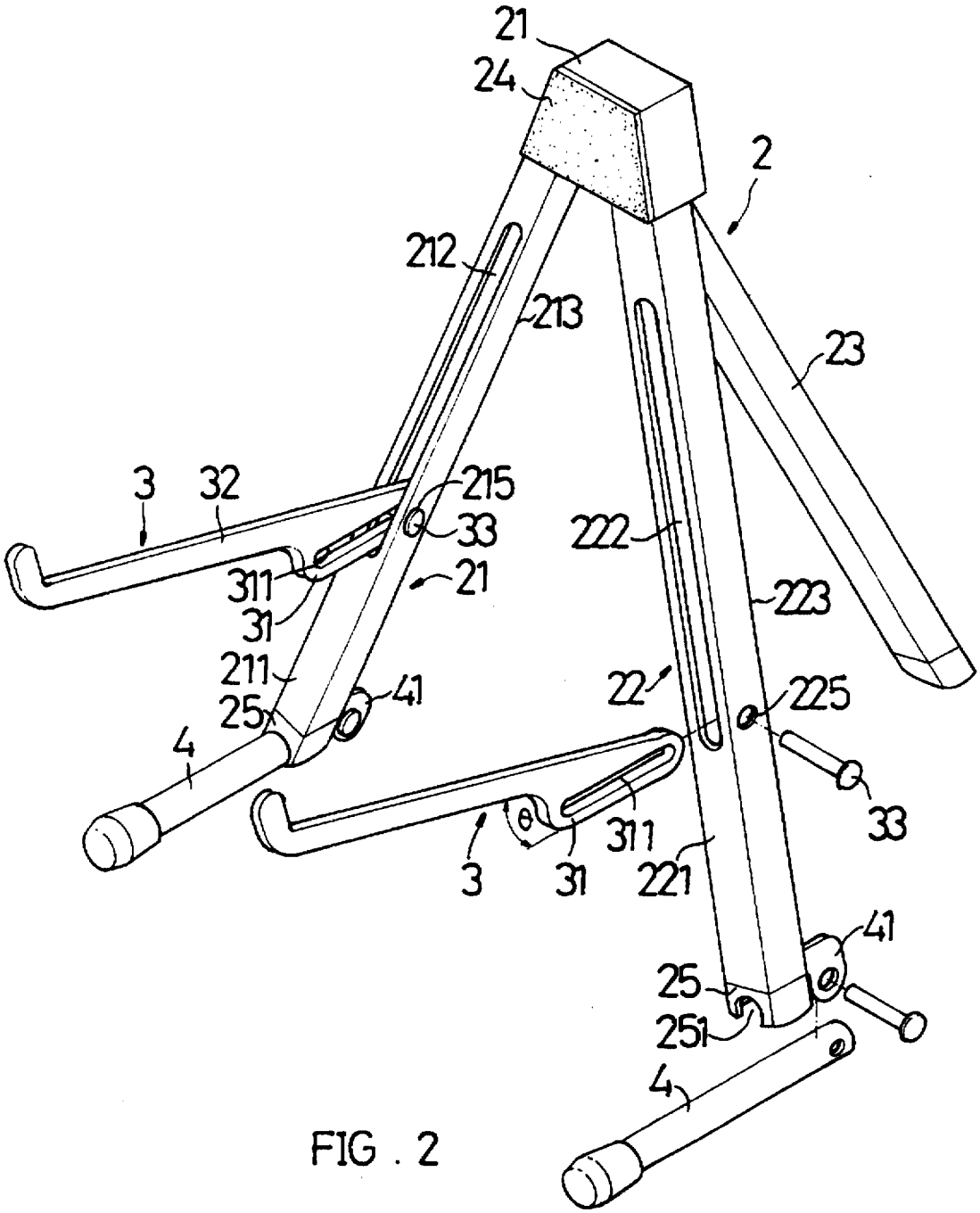
FIG. 2 is a perspective exploded view of a first embodiment of the present invention.
Figure 3:
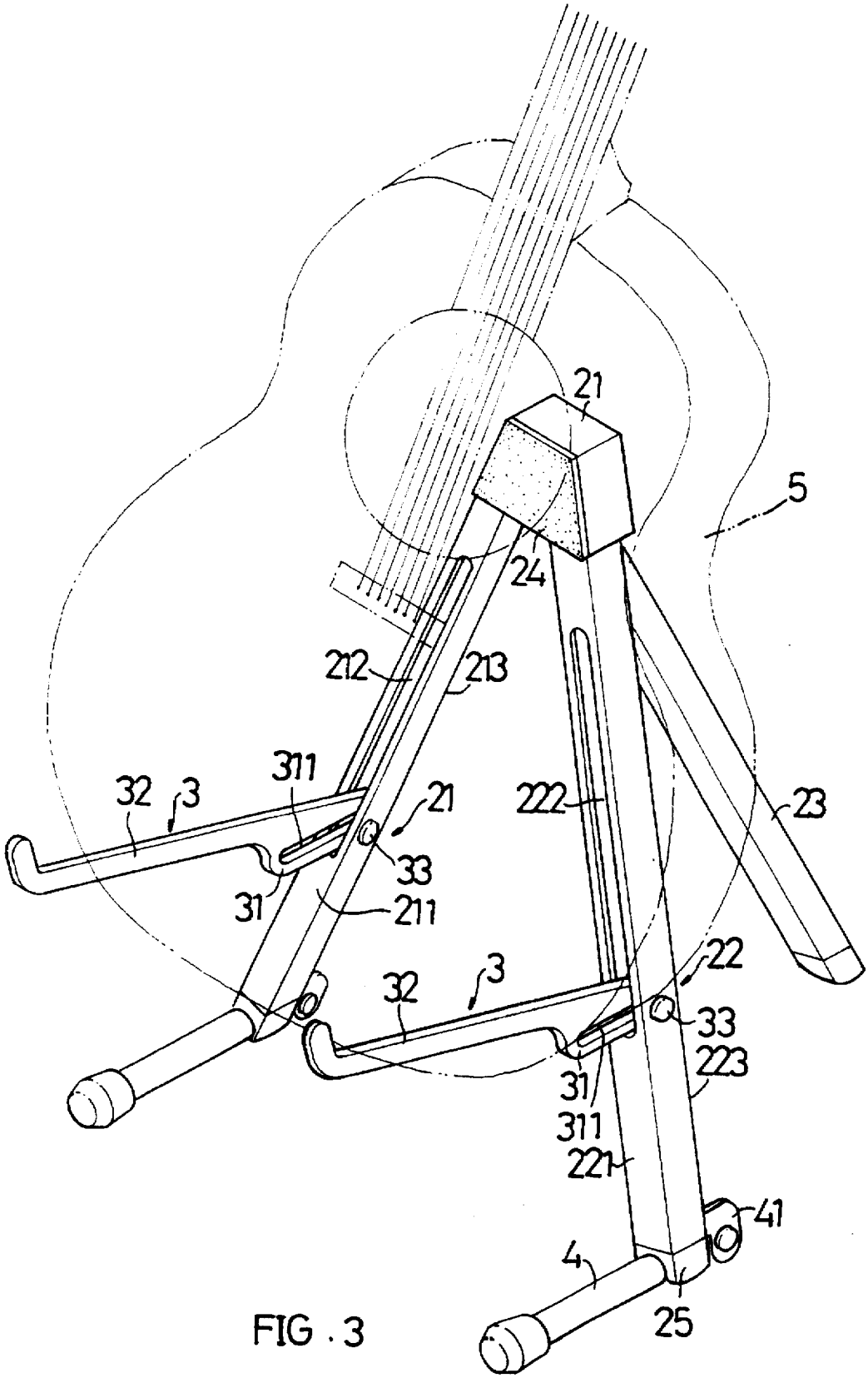
FIG. 3 is a perspective assembled view of the first embodiment of the present invention.

Please refer to FIGS. 2 and 3 which show a first embodiment of the present invention. In this embodiment, the article stand includes a tripod 2, two support levers 3 and two tiltproof rods 4.

The top end of the tripod 2 is disposed with a pivot section 21 pivotally connected with the top ends of a first, a second and a third legs 21, 22, 23 which have rectangular cross-sections. The three legs can be pivoted open into a substantially tetrahedron pattern for supporting an article. Alternatively, the three legs 21, 22, 23 can be contracted or folded into a small volume. A slipproof pad member 24 is attached to a front face of the pivot section 21 for the body 5 of a guitar to lean thereagainst. Each leg 21, 22, 23 is disposed with a leg pad 25 at the bottom end.

Figure 4:
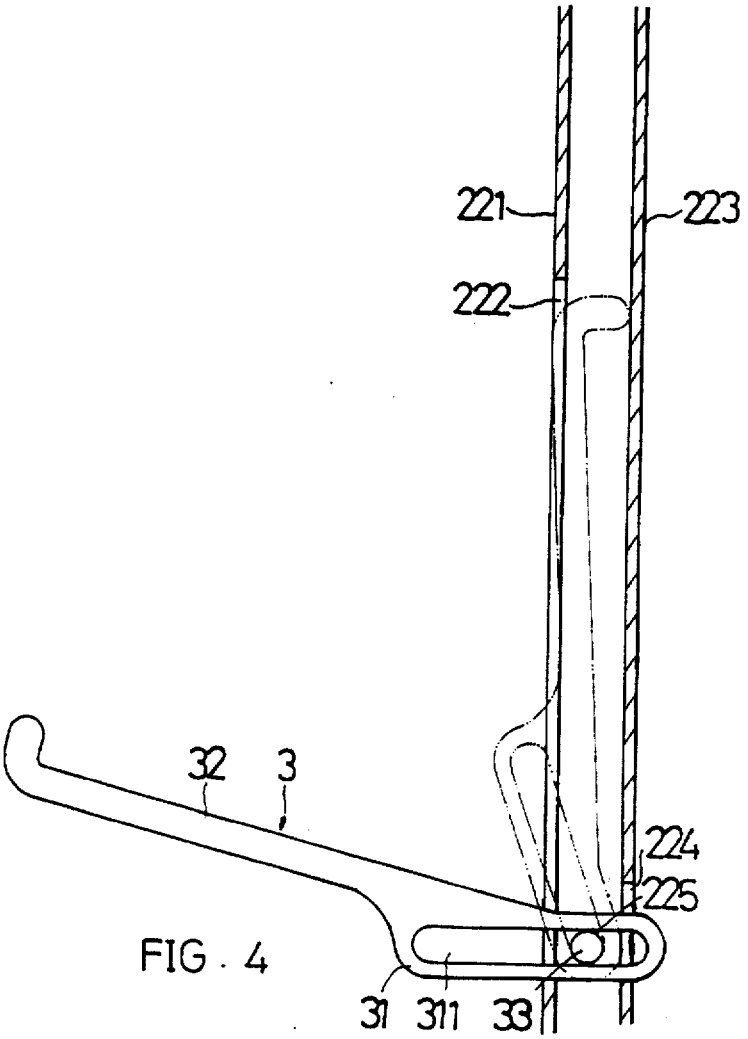
FIG. 4 is a sectional view taken along line IV—IV of FIG. 3.

Please refer to FIG. 4. The front faces 211, 221 of the first and second legs 21, 22 are respectively formed with two first slots 212, 222 with equal height. Opposite to the front faces, the rear faces 213, 223 of the first and second legs 21, 22 are respectively formed with two second slots 214, 224 with equal height. The second slots 214, 224 communicate with the first slots 212, 222 but the height of the second slots is less than that of the first slots. In addition, near the bottom ends of the first slots 212, 222, the first and second legs 21, 22 are respectively formed with locating holes 215, 225 with a height between the top ends and bottom ends of the second slots 214, 224.

Each support lever 3 is made of an iron plate by punching, including an adjustment section 31 and a support section 32 which contain an angle for increasing the supporting strength of the support section 32. The adjustment section 31 is formed with a slot 311, whereby the two adjustment sections 31 are respectively inserted into the first slots 212, 222 of the first and second legs 21, 22 and passed through the second slots 213, 223 thereof. Then two rivets 33 are respectively inserted into the locating holes 213, 223 of the first and second legs 21, 22 and the slots 311 of the adjustment sections 31 so as to fasten the adjustment sections 31 in the first and second legs 21, 22.

When a user wants to fold it, the two support levers 3 are upward rotated to hide the support sections 32 inside the first slots 212, 222 of the first and second legs 21, 22. At this time, the adjustment sections 31 are partially exposed outside the first slots 212, 222.

When a guitar needs to be put on the tripod, the support levers 3 are downward rotated with the adjustment sections 31 abutting against the bottom ends of the first slots 212, 222, whereby a space is defined between the support sections 32 and the first and second legs 21, 22 for receiving the body 5 of the guitar. The adjustment sections 31 can be moved relative to the rivets 33 so as to change the space between the support sections 32 and the first and second legs 21, 22 in accordance with the thickness of the body 5 of the guitar.

Figure 5:
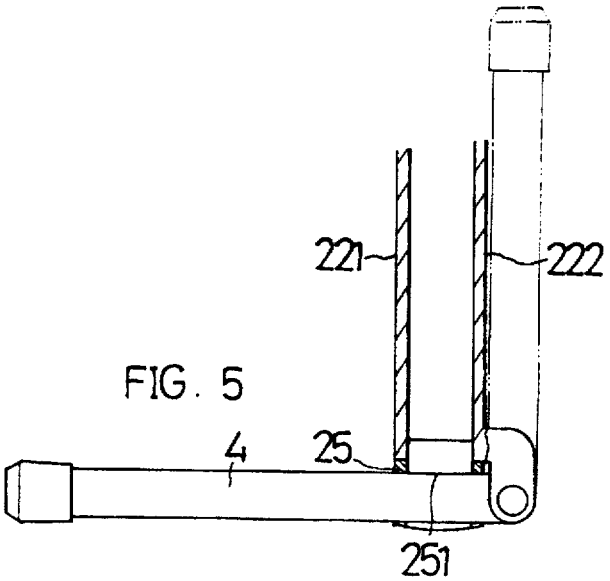
FIG. 5 is a sectional view taken along line V—V of FIG. 3.

Referring to FIG. 5, two leg seats 41 are disposed on rear faces 213, 223 of the bottom ends of the first and second legs 21, 22. The two tiltproof rods 4 are pivotally connected with the leg seats 41 and can be rotated to be oriented in the same direction as the support levers 3. The tiltproof rods 4 are partially hidden in the recesses 251 of the leg pads 25 of the first and second legs 21, 22 with the leg pads 25 still contacting with the ground. Accordingly, the tiltproof rods 4 extend forward to increase the contacting area between the leg pads 25 and the ground and lower the gravity center of the article stand. Thereby, the article stand is prevented from tilting forward and falling down due to external force coming from rear side.

Figure 6:
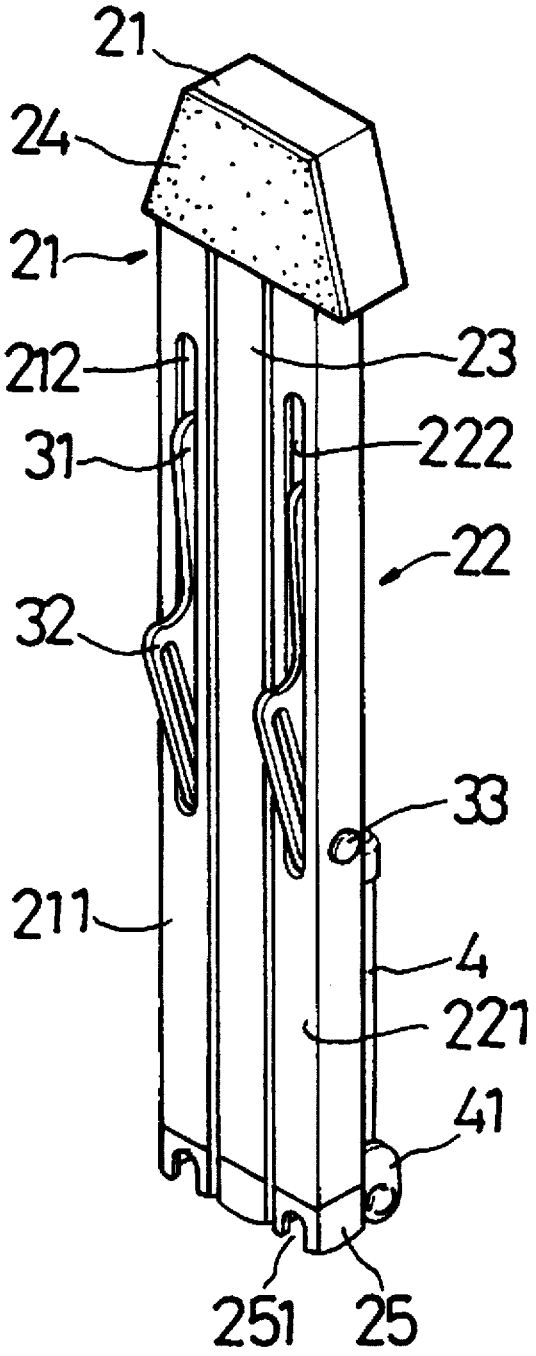
FIG. 6 is a perspective view showing the first embodiment of the present invention in a folded and contracted state.

Referring to FIG. 6, the support sections 32 of the support levers 3 can be folded and received in the legs 21, 22 with only a part of the adjustment sections protruding outside. A user can pull this part with fingers so as to rotate the support levers 3. In addition, the tiltproof rods 4 can be rotated rearward to lean on the first and second legs 21, 22. Finally, the first, second and third legs 21, 22, 23 contracted and collected together into a very small volume without occupying much room.

The article stand of the present invention is not only designed for a guitar to rest thereon, but also for a tennis racket to rest thereon. This is because the tennis racket similarly has an elliptic bulge section as the body of the guitar. Therefore, the tennis racket can be also stably rested between the support levers.

Figure 7:
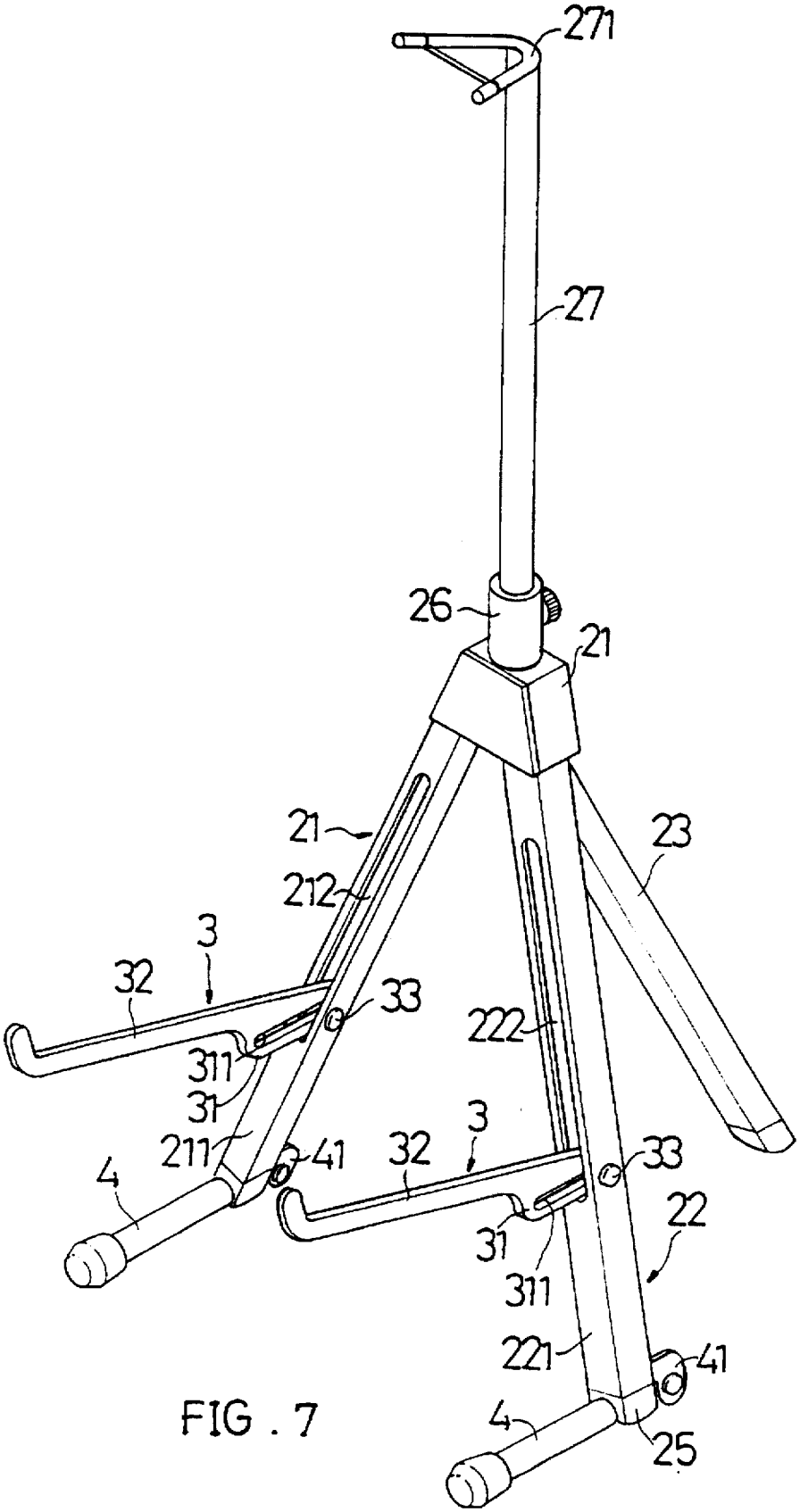
FIG. 7 is a perspective assembled view of a second embodiment of the present invention.

FIG. 7 shows another embodiment of the present invention, in which a socket 26 is disposed at the top end of the pivot section 21 of the tripod 2 for the bottom end of an auxiliary rod 27 to insert therein. The top end of the auxiliary rod 27 is disposed with a fork 271 for the neck (not shown) of the guitar to lean thereagainst so as to enhance the stability of the present invention.

It is to be understood that the above description and drawings are only used for illustrating some embodiments of the present invention, not intended to limit the scope thereof. Any variation and derivation from the above description and drawings should be included in the scope of the present invention.

What is claimed is:

1. An article stand comprising:

a tripod having a top end disposed with a pivot section pivotally connected with top ends of a first, a second and a third legs which can be pivoted open for supporting an article or contracted and collected for reducing the volume of the article stand, front faces of the first and second legs being respectively formed with first slots with equal height, opposite to the front faces, the rear faces of the first and second legs being respectively formed with second slots with equal height, the second slots communicating with the first slots but the height of the second slots being less than that of the first slots, near the bottom ends of the first slots, the first and second legs being respectively formed with locating holes with a height between the top ends and bottom ends of the second slots;

two support levers each including an adjustment section and a support section which contain an angle therebetween, the adjustment section being formed with a slot, whereby the two adjustment sections of the two support levers are respectively inserted into the first slots of the first and second legs and passed through the second slots thereof, two locating members being respectively inserted into the locating holes of the first and second legs and the slots of the adjustment sections, the adjustment sections of the support levers contacting with the bottom ends of the first and second slots and being movable relative to the locating members via the slots so as to change the space between the support sections and the first and second legs, the support levers being foldable to be received in the first slots of the first and second legs.

2. An article stand as claimed in claim 1, wherein the locating members are rivets passing through the locating holes of the first and second legs and the slots of the adjustment sections of the support levers for fastening the support levers and the first and second legs.

3. An article stand as claimed in claim 1, wherein the support lever is integrally made of iron plate by punching.

4. An article stand as claimed in claim 1, wherein the bottom end of each leg of the tripod is disposed with a slipproof leg pad.

5. An article stand as claimed in claim 1, wherein a slipproof pad member is attached to a front face of the pivot section of the tripod on the same side as the support levers.

6. An article stand as claimed in claim 1, wherein two tiltproof rods are pivotally connected to rear faces of the bottom ends of the first and second legs, the two tiltproof rods being rotatable to be oriented in the same direction as the support levers and partially hidden in recesses of the leg pads of the first and second legs with the leg pads still contacting with the ground, whereby the tiltproof rods increase the contacting area between the leg pads and the ground and lower the gravity center of the article stand, so that the article stand is prevented from tilting forward and falling down due to external force coming from rear side.

7. An article stand as claimed in claim 1, wherein a socket is disposed at the top end of the pivot section of the tripod for an auxiliary rod to insert therein.

* * * * *